US005354027A

United States Patent [19]

Cox

[11] Patent Number: 5,354,027

[45] Date of Patent: Oct. 11, 1994

[54] FLIP TOP REMOVABLE TABLE SYSTEM

[75] Inventor: Lewis D. Cox, Knoxville, Tenn.

[73] Assignee: Falcon Products, Inc., Newport, Tenn.

[21] Appl. No.: 233,227

[22] Filed: Apr. 26, 1994

Related U.S. Application Data

[63] Continuation of Ser. No. 879,183, May 5, 1992, abandoned.

[51] Int. Cl.[5] ..... A47B 3/00

[52] U.S. Cl. ..... 248/291; 248/188.1; 108/150; 108/115; 108/157

[58] Field of Search ..... 248/188.1, 188.2, 291; 108/1, 150, 157, 160, 115, 3

[56] References Cited

U.S. PATENT DOCUMENTS

| | | | |
|---|---|---|---|
| 203,649 | 5/1878 | Runton | 108/1 |
| 677,790 | 7/1901 | Northgraves | 108/1 |
| 2,011,627 | 8/1935 | Graham | 108/1 |
| 3,993,004 | 11/1976 | Alme | 108/124 |
| 4,643,105 | 2/1987 | Baum | 108/150 |
| 4,773,337 | 9/1988 | Ball | 108/150 |
| 4,986,195 | 1/1991 | Diffrient | 108/150 |
| 5,121,697 | 6/1992 | Baum et al. | 108/150 |
| 5,174,225 | 12/1992 | Reise et al. | 108/150 |

*Primary Examiner*—Eugenia Jones
*Assistant Examiner*—Allan M. Schrock
*Attorney, Agent, or Firm*—Polster, Lieder, Woodruff & Lucchesi

[57] ABSTRACT

A mechanism for attaching a tabletop to at least one vertical support that permits movement of the tabletop with respect to the vertical support consisting of a top plate and a bottom plate, the top plate attachable to the tabletop and the bottom plate being attachable to the vertical support. The two plates are connected by a hinge mechanism that allows movement of the top from a horizontal to a vertical position and also allows the top to be removed from the vertical support for storage. The mechanism has easily operated, releasable locking means for holding the top plate to the bottom plate when the tabletop is in a horizontal position.

7 Claims, 2 Drawing Sheets

FLIP TOP REMOVABLE TABLE SYSTEM

This is a continuation application of copending application Ser. No. 07/879,183, filed on May 5, 1992, now abandoned.

BACKGROUND OF THE INVENTION

This invention relates generally to table mechanisms and in particular, to a device used to attach tabletops to one or more vertical supports. More specifically, this invention relates to a mechanism for attaching a tabletop to one or more vertical supports that will allow the tabletop to rest in a horizontal and useful position but also allows the tabletop to be tilted to a vertical position for cleaning or storage. The mechanism also allows the tabletop to be disengaged and removed from the vertical support to further enhance space saving objectives of this invention when the table is not in use or when the table is in storage.

A fully assembled table occupies a considerable amount of space. Generally, the planar surface of the table i.e., the tabletop, extends well beyond the vertical support or supports. It is often desirable to use the space ordinarily occupied by a table for some other activity when the table is not being used. For example, a dining room may be filled with tables to accommodate diners at a meal. After the meal is finished, the room may be cleared so that the dining room can be cleaned. Also, the tables can be pushed or stacked against the wall so that the room can be used for other activities such as dancing or meetings. It is also often desirable to move the table against the wall, or to store the table in a storage facility or closet. Activities such as cleaning and storage are difficult to do with many table designs. As will be appreciated by those skilled in the art, tables are difficult to store or hide away since the tabletop occupies a considerable square foot area.

Space saving table designs are known to the art. For example, folding or collapsible tabletop designs have been employed for a long time. However, a folding or collapsible table, by design, employs multiple moving parts, is awkward to fold or collapse, and often requires one or more person to manipulate. The folding or collapsible table often is prone to pinching fingers; is wobbly and unstable; and lacks aesthetic appeal. Moreover, the folding or collapsible design is not suitable for smaller tables employing a single, vertical support or pedestal. A single pedestal table is often easier to use since the single, centrally placed table support facilitates positioning chairs around the table. Such tables are often used in restaurants where the vertical table support is fixed. A fixed arrangement enables a space planner, for example, to achieve maximum seating capacity in the available square foot area. The ability to clean such areas, as indicated above, becomes a problem unless the tabletop mechanism is employed to permit at least tabletop movement.

The prior art has attempted to alleviate some of the problems associated with collapsible or folding tables by constructing tables with tiltable or removable tabletops. The top can be tilted to a vertical position, thereby reducing the overall width of the table and allow for a more convenient cleaning or storage. While the prior art works for its intended purpose, the designs have a number of draw backs. These include a lack of strength and stability, complex working parts, and intricate hinging and locking mechanisms, with the associated expense of manufacturing and assembling. Among these prior art references of which I am aware are U.S. Pat. No. 3,993,004, to Alme. Alme discloses a mechanism which, in contrast to the present invention, has a number of working parts, is complex, requires considerable labor to construct, and employs a difficult to manipulate locking apparatus to keep the tabletop in its horizontal position.

The U.S. Pat. No. 4,643,105, to Baum, also shows a tiltable mechanism. I do not believe its tiltable mechanism has the lateral ridgidity of the mechanism of the present invention. In addition, the '105 patent employs an extra latching mechanism.

The U.S. Pat. No. 4,986,195, to Different, also discloses a tilting tabletop mechanism. However, this mechanism is complicated in construction.

While the aforementioned constructions may function to allow the tabletop to be tilted or removed, the present invention is designed to use a minimum number of moveable parts, to add rigidity and stability to the assembly, and to work smoothly and easily with a minimum of user effort.

SUMMARY OF THE INVENTION

It is one of the objects of this invention to provide a simple mechanism for securing a tabletop to a vertical support that allows movement of tabletop from a horizontal to a vertical position.

Another object of this invention is to provide a mechanism for securing a tabletop to a vertical support that allows easy disengagement of the tabletop from the vertical support so that the tabletop may be removed.

Still anther object of this invention is to provide such a mechanism that is aesthetically pleasing to and tactile in use for the user.

Yet another object of this invention is to provide a means for securing a tabletop in a horizontal and useful position that requires few moving parts.

Yet another object of this invention is to provide such a mechanism for tiltably and removably attaching a tabletop to a vertical support that has a mechanism for securing the tabletop in a horizontal and useable position that is simple and easy to engage and disengage.

Another object of this invention is to provide such a mechanism that is simple and economical to manufacture and assemble.

Other objects will be apparent to those skilled in the art in view of the following description and accompanying drawings.

In accordance with the invention generally stated, a mechanism for connecting a tabletop to at least one vertical support is provided which allows the top to be locked in place in a useable and horizontal position. Simple structure is provided to allow the planar top to be removed from the vertical support when the planar top is in a vertical position. The mechanism is designed so that the table assembly is readily stored when not in use. The mechanism includes a generally flat, rectangular top plate ridgidly fixed to the underside of a tabletop. A corresponding bottom plate is ridgidly affixed to the underside of a tabletop. The bottom plate is ridgidly affixed to the top of a vertical support. The top plate and the bottom plate are hingedly connected so that the top plate can be superposed over the bottom plate in the horizontal position of the tabletop. The mechanism has a simple hand operated locking means to secure the top plate to the bottom plate.

Figure 3:
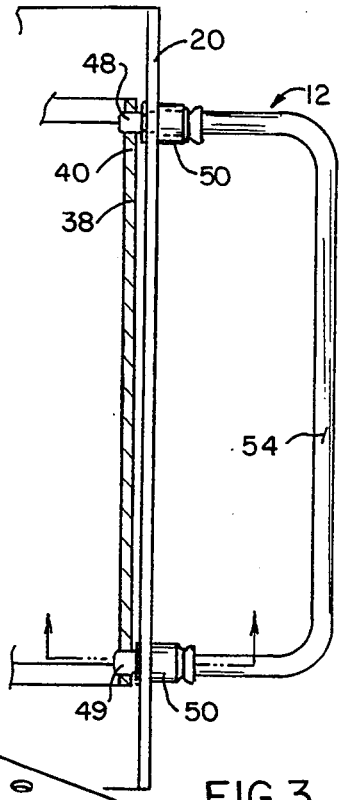
FIG. 3 is a bottom plan of one illustrative embodiment of locking mechanism used in connection with the embodiment of FIGS. 1 and 2.

FIGS. *7a–b* is a cross-sectional view of a plunger assembly taken across line 7—7 of FIG. 3; and FIGS. *8a–b* is a cross-sectional view of another embodiment, similar to FIGS. *7a–b*.

Figure 9:
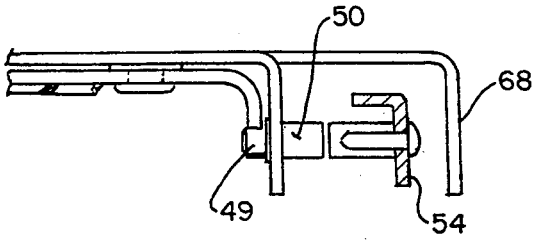

FIG. 9 is a side view of the plunger assembly and handle.

DESCRIPTION OF THE PREFERRED EMBODIMENT

Figure 1:
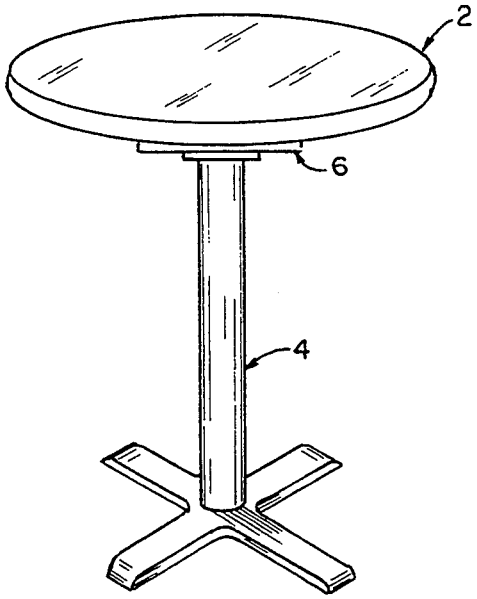
FIG. 1 is a perspective view of a table employing one illustrative embodiment of connector system of the present invention used to attach a tabletop to a vertical support.
Figure 6:
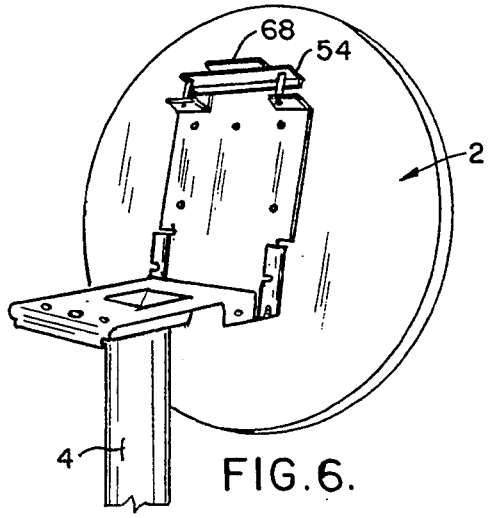
FIG. 6 is a perspective view of a table assembly employing a second illustrative embodiment of the present invention showing a tabletop, positioned vertically to the support.
Figure 7A:
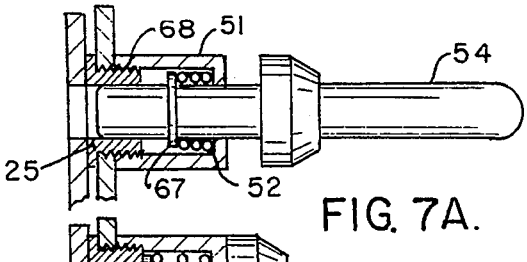
Figure 7B:
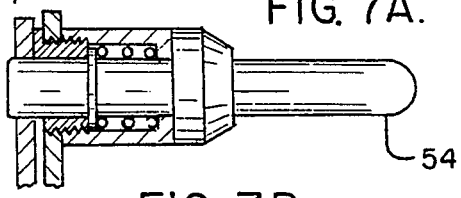
Figure 8A:
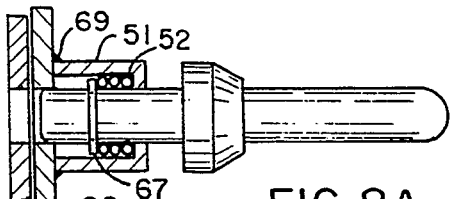
Figure 8B:
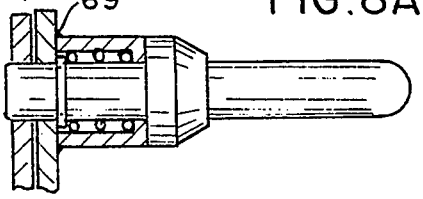

This invention discloses a connector mechanism for tiltably connecting a tabletop 2 to at least one vertical support 4. As shown in FIG. 1 of a tabletop 2 is mounted to the vertical support 4 by employing one illustrative embodiment of mechanism of the present invention shown generally at 6. Mechanism 6 permits tabletop 2 to be moved between the horizontal position of FIG. 1 and a substantially vertical position shown in FIG. 6.

Figure 2:
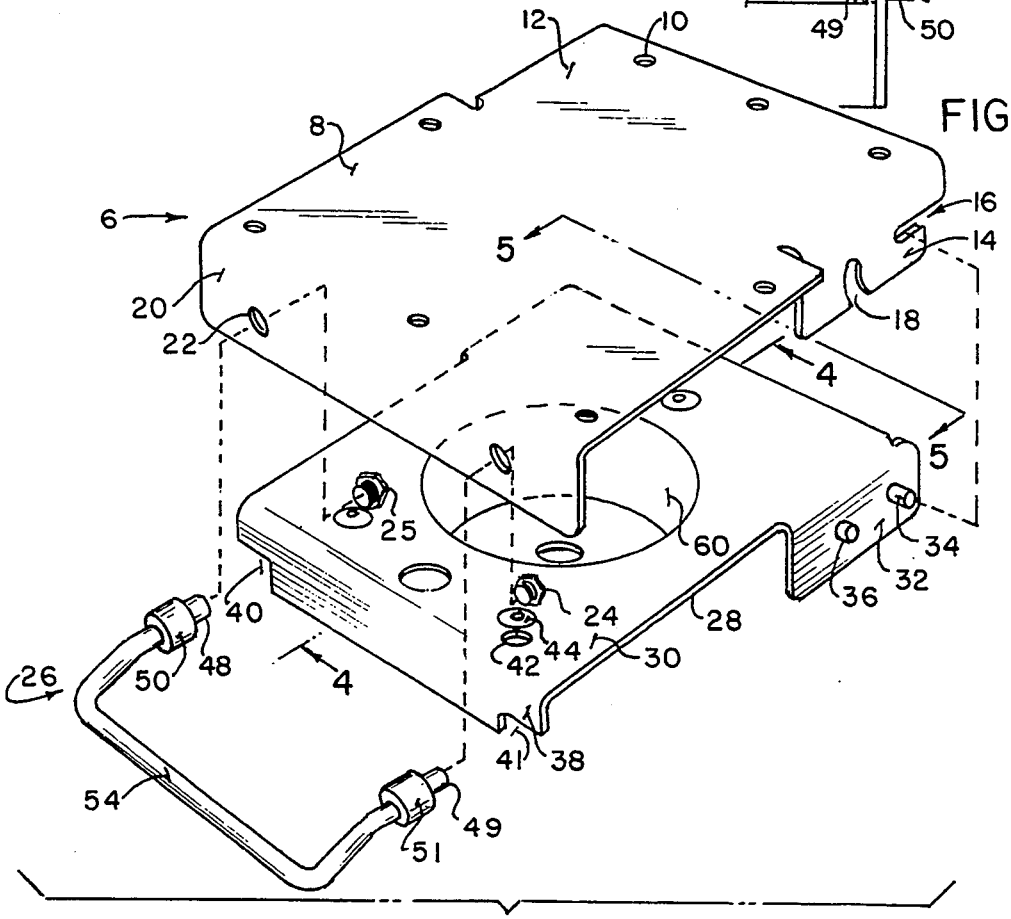
FIG. 2 is an exploded perspective view of the connector system shown in FIG. 1.

Referring to FIG. 2, mechanism 6 includes a top plate 8 which is mounted to the underside of tabletop 2 by screws (not shown) or other means through a plurality of holes as shown at 10. Other means for attaching table top plate 8 to a tabletop may be used without departing from the scope of the present invention. Top plate 8 has a generally flat web portion 12, depending sides 14 each containing a horizontal groove 16 and an arcuate guide channel 18, and a depending front lip 20 having openings 22 formed in it which seat bushings 24 & 25. Bushings 24 & 25 in turn accept plungers 48 and 49 of a locking mechanism, shown generally at 26.

Bottom plate 28 has a generally flat web portion 30 with depending sides 32 each having a pivot stud 34 and a stop 36 associated with it. Bottom plate 28 also has a depending front lip 38 integrally formed with web portion 30. Lip 38 defines receiving means 40 and 41 for receiving plungers 48 and 49 of locking mechanism 26 when top plate 8 is horizontally superposed on bottom plate 28 (see FIG. 3). Web 30 has a plurality of holes 42 formed in it, each being used to seat rubber grommets 44. Rubber grommets 44 function to absorb noise and vibration when top plate 8 is superposed on bottom plate 28.

The sides 14 of top plate 8 and the sides 32 of bottom plate 28 are closely interfitted with room to allow relative rotation between top plate 8 and bottom plate 28. Pivot studs 34 extending outwardly from sides 32 are positioned so as to be are aligned in grooves 16 in order to permit tilting of tabletop 2 between horizontal and vertical positions. Grooves 16 have a width slightly greater than studs 34 so that top plate 8 can pivot about studs 34. Groove 16 is open posteriorly in order to allow removal of tabletop 2 from the vertical support. The tabletop 2 is moved vertically so that groove 16 is vertical to side 32 and the top is simply lifted off, disengaging groove 16 from studs 34. Groove 16 is deep cut, and when tabletop 2 is in a vertical position, stud 34 seats deep within groove 16, the underside posterior portion of plate 8 abutting the external posterior portion of plate 28 thereby bracing the top and preventing the tabletop from tilting too far backwards thus allowing the top to remain in a vertical position under the force of gravity.

Figure 5:
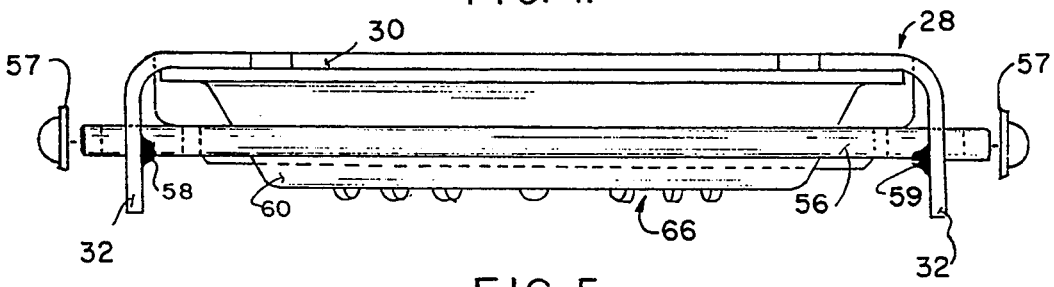
FIG. 5 is a rear elevational view of an alternative embodiment of the present invention as viewed along the line 5—5 of FIG. 2.

In an alternative embodiment, shown generally in FIG. 5, means for allowing movement between the horizontal and vertical position of tabletop 2 is a hinge 56 that extends along the width of the posterior portion of bottom plate 28 and can be affixed by welds, as at 58 and 59, to each of the sides 32 or left without welds. In this embodiment, hinge 56 extends through holes (not shown) in sides 14 of top plate 8 and capped with push-on cap nuts 57. Top plate 8 can be pivoted about hinge 56 but cannot be removed.

When tabletop 2 is placed in a horizontal useful position, plate 8 is superposed on plate 28. As top plate 8 is moved into a horizontal position, stop 36, which extends outward from sides 32, is engaged by arcuate guide channel 18 to provide correct alignment and stability. As indicated above, top plate 8 rests against grommets 44 in the horizontal position of the tabletop 2 to provide a snug fit with bottom plate 28.

Top plate 8 is held in place against bottom plate 28 by a locking mechanism shown generally at 26. Locking mechanism 26 has a handle 54 connected to a pair of plungers 48, 49 and their respective plunger housings 50 and 51. In one embodiment, plunger housings 50, 51 have internal threads 68 for attaching the housing to bushings 24 having complementary external threads 25 (see FIGS. *7a–b*). In another embodiment, (FIGS. *8a–b*) housings 51 and 52 are attached to front 38 as by welds 69. Other mounting arrangements are compatible with the broader concepts of my invention. Plungers 48 and 49 are biased outward by bias spring 53 positioned within housings 51 and 52. When top plate 8 is secured against bottom plate 28, plungers 48 and 49 are biased into receiving means 40 and 41. To unlock the mechanism and allow the tabletop to move to a vertical position for storage, the user pulls handle 54 to retract plungers 48 and 49 (see FIGS. *7a–b*). Plungers 48 and 49 recede from receiving means 40 and 41 to allow disengagement of top plate 8 from bottom plate 28. Receiving means 40 and 41 are shown in FIG. 2 as notches in lip 38. However, receiving means 40 and 41 can be notches, holes, or any other appropriate means for seating plungers 48 and 49 in bottom plate 28. Handle 54, as shown in FIGS. 2 and 3 is formed from heavy gauge wire. However, handle 54 can be of any shape or configuration that is tactile in use and aesthetically pleasing. For example, in an alternative embodiment, shown in FIG. 6, handle 54' is formed as a flat, elongated member that can be grasped with the fingertips and squeezed against a member 68.

Figure 4:
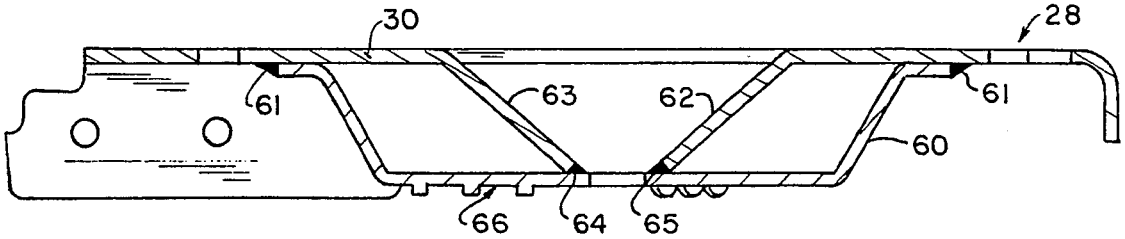
FIG. 4 is a cross-sectional view of the bottom plate taken along the line 4—4 of FIG. 2.

In the embodiment illustrated bottom plate 28 is formed from two pieces, a flat web 30 and a dish piece 60 (see FIG. 4). Web 30 is positioned over dish 60 and welded around the top circumference of dish 60 as at 61. Tabs 62 and 63 are formed in web 30 during manufacturing and are bent downwardly into dish 60 upon assembly and welded therein at 64 and 65. This two-piece assembly allows for a more ridgid construction of base plate 28 while using lighter gauge metal. Base plate 28 is attached to vertical support 4 at 66 using welds, bolts, or any other satisfactory means for attaching dish 60 of plate 28 to such vertical support.

Numerous variations, within the scope of the appended claims, will be apparent to others skilled in the art in light of the foregoing description and accompanying drawings. The over-all design silhouette of the plates 8 and 28 may vary in other embodiments of my invention. Likewise, the various methods of attaching the individual structural components to one another may be varied. Materials used for the top and bottom plates may be changed. While I prefer to use dual spring structures for locking mechanism 26, a single spring structure may be employed, if desired. The grooves 16 may be permanently close, if desired, with using the hinge 56. The biasing springs may be eliminated from mechanism 26, locking and unlocking occurring by frictional engagement of the parts. These variations are merely illustrative.

Having thus described the invention, what is claimed and desired to be secured by Letters Patent is:

1. A mechanism for permitting movement of a planar tabletop with respect to at least one vertical support, comprising:

a top plate, said top plate having a base, a front wall, a first side and a second side, each of said first and second sides having an open-mouth pivot groove and an open-mouth arcuate guide channel formed in it, said front including at least one plunger assembly for locking said top plate to a bottom plate in a horizontal position of said table top, said plunger assembly having a plunger housing mounted to said top plate along the front wall thereof and a plunger biased to extend outwardly of said housing;

a bottom plate having a base, a front, a pair of sides, said front having a seat for engaging said plunger, said pair of sides having means for pivotally engaging said top plate, a stud protruding from each of said sides, each of said studs being positioned to engage said arcuate guide channel in the side of said top plate to provide alignment and stability when said top plate is lowered to a superimposed position over said bottom plate; and means for attaching said bottom plate to said at least one vertical support.

2. The mechanism of claim 1 wherein said plunger assembly further includes a handle apparatus, said handle apparatus being connected to said plunger so as to permit movement of said handle to retract said plunger within said plunger housing.

3. The mechanism of claim 2 wherein said plunger assembly includes a spring positioned within said housing and adapted to bias said plunger outwardly from said plunger housing.

4. The mechanism of claim 2 wherein said seat comprises a member depending from the base of said bottom plate, said depending member having a receiving means associated with it, said receiving means being aligned with said plunger in the horizontal position of said table top so as to receive said plunger and lock said table top in its horizontal position.

5. The mechanism of claim 4 wherein said means for pivotally engaging said top plate further include at least one projection extending outwardly from a side of said bottom plate, said projection being engaged in said pivot groove of said top plate to permit rotational movement about said projection.

6. The mechanism of claim 4 wherein said means for pivotally engaging said top plate comprise a hinge pin extending horizontally along the length of said base plate, said hinge pin including ends which project outwardly from at least one side of said base plate, the projecting end of said hinge pin being received in the pivot groove of said top plate.

7. A device for attaching a tabletop to a vertical support, said device permitting the tabletop to be tilted vertically relative to and to be removed from the vertical support, comprising:

a top plate, said top plate having a base, a front first side, a second side, and a front, each of said first and second sides having an open-mouth arcuate guide channel and an open-mouth pivot groove formed in it, a handle mounted on the front of said top plate;

a plunger assembly mounted to said top plate, said plunger assembly including a housing, a plunger cooperatively connected to said handle, and a spring for biasing said plunger outwardly of said plunger housing;

a base plate, said base plate having at least one side and a front, said at least one side having a stud extending outwardly therefrom, the stud being engaged by the arcuate groove in said top plate, and a hinge assembly for removably engaging said top plate, said hinge assembly including an extension extending outwardly from the side wall of said base plate, said extension being engageable in the pivot groove in said top plate, said front having a receiving means for accepting the plunger of said plunger assembly when said top plate is superimposed over said bottom plate; and means for attaching said base plate to a vertical support.

* * * * *